United States Patent [19]

Zimmerman

[11] 4,065,348

[45] Dec. 27, 1977

[54] METHOD AND APPARATUS FOR DETECTING AND CONTROLLING THE CAUSTIC IN PAPER PULP BLEACHING

[75] Inventor: William E. Zimmerman, Covington, Va.

[73] Assignee: Westvaco Corporation, New York, N.Y.

[21] Appl. No.: 686,305

[22] Filed: May 14, 1976

Related U.S. Application Data

[63] Continuation-in-part of Ser. No. 570,666, April 23, 1975, abandoned.

[51] Int. Cl.[2] ..... D21C 7/12

[52] U.S. Cl. ..... 162/49; 162/62; 162/238; 23/230 A; 23/253 A; 204/1 T; 204/195 R

[58] Field of Search ..... 162/49, 238, 262, 263, 162/62, DIG. 10; 137/93; 23/230 A, 253 A; 204/1 A, 1 T, 195 R, 196

[56] References Cited

U.S. PATENT DOCUMENTS

| | | | |
|---|---|---|---|
| 2,307,137 | 1/1943 | Kennedy | 162/49 |
| 2,466,290 | 4/1949 | Wells | 162/49 |
| 3,051,631 | 8/1962 | Harbin, Jr. et al. | 162/238 X |
| 3,375,183 | 3/1968 | Banks et al. | 204/196 |
| 3,486,971 | 12/1969 | Weyrick | 162/49 |
| 3,528,778 | 9/1970 | McKaveney et al. | 204/1T X |
| 3,565,769 | 2/1971 | Holden et al. | 204/195 R |
| 3,729,375 | 4/1973 | Chappelle | 162/238 |
| 3,769,189 | 10/1973 | Long | 204/195 R |
| 3,968,006 | 7/1976 | Zimmerman | 162/238 |

OTHER PUBLICATIONS

Burnett; "Computer Control of the Chlorine Stage" 7-1970 *Pulp and Paper Magazine of Canada;* pp. 57-62, vol. 71, No. 14.

Shera, "Systems Compatability for ORP Pulp Chlorination Control" *TAPPI*; Feb. 1967, vol. 50, No. 2.

Strom; "Improved Chlorination Control By Color Measurement"; *TAPPI*; vol. 56, No. 11, Nov. 1973.

Lenz et al.; "Ion-Selective Electrode Method Compared to Standard Methods for Sodium Det. in Mill Liquors"; *TAPPI*; vol. 54, No. 12.

*Primary Examiner*—S. Leon Bashore
*Assistant Examiner*—Steve Alvo
*Attorney, Agent, or Firm*—W. Allen Marcontell; Richard L. Schmalz

[57] ABSTRACT

In a paper pulp bleach plant, the concentration of residual caustic in solution with the pulp slurry may be measured as a function of the voltage across cathode and anode poles of an electrolytic cell comprising the pulp slurry solution as the electrolyte and ferro-metallic walls of the slurry container as the cathode or anode pole. The opposite cell pole is selected from a group of metals and alloys thereof discretely removed from iron in the electromotive series, the specific pole metal or alloy within the group being selected on the basis of resistance to chemical reactivity at the point of pole placement in the pulp flow stream. Control over the flow of caustic into the slurry flow stream may be exerted in response to an error signal generated from cascade management of the voltage emissions from two such cells positioned early and late, respectively, in the pulp flow stream respective to the caustic injection point.

12 Claims, 5 Drawing Figures

METHOD AND APPARATUS FOR DETECTING AND CONTROLLING THE CAUSTIC IN PAPER PULP BLEACHING

CROSS REFERENCE TO RELATED APPLICATION

This application is a Continuation-In-Part of my earlier copending application Ser. No. 570,666 filed on Apr. 23, 1975 and now abandoned.

BACKGROUND OF THE INVENTION

1. Field Of The Invention

The present invention relates to the bleaching of wood pulp. More specifically, the present invention relates to the sensing of residual caustic concentration in a paper pulp bleaching system and the exercise of control over the flow of caustic into a pulp bleach plant flow system.

2. Description Of The Prior Art

Since the objective of caustic treatment of paper pulp flowing chlorination and washing is to neutralize any residual chlorine and hydrolyze chlorinated lignin radicals for wash removal, the prior art control practice over caustic addition to the pump flow stream has been to add caustic as a function of either the chlorine addition flow rate or of the chlorine residual at some point along the chlorine retention flow path.

If metered as a function of chlorine addition, the caustic flow control system represents a feed-forward control over the caustic flow stream wherein caustic is added to the pulp slurry flow stream in some direct proportion to the quantity of chlorine added to the same approximate flow segment within the slurry stream. This system however, fails to acknowledge variables that are characteristically unique to successive flow segments of the continuous slurry flow stream. Such variables may comprise species differences in the wood furnish and the degree of digestion as represented by the pulp "K" Number. Other variables in the degree of chlorine reaction with a given slurry flow segment may include retention time (flow rate), temperature, consistency and pH characteristics. Such variables result in percentage variations of chlorinated lignin respective to successive slurry flow segments. Consequently, the quality of caustic necessary to both neutralize residual chlorine and hydrolyze chlorinated lignin will vary as a more complex function of the chlorine quantity applied.

U.S. Patent Application B Ser. No. 300,004 describes a paper pulp bleaching plant wherein caustic is combined with the slurry flow stream as a function of the chlorine residual at some fixed point in the chlorination system. Although the pulp "K" Number is also a function of the caustic demand determination, the system is extremely complex in the total quantity of instrumentation and telemetering required for a quantitative conclusion.

Such cumbersome and ungainly control techniques over the continuous metering of caustic into the pulp slurry flow stream as described above have resulted from a lack of means to directly and reliably measure caustic effectiveness on the slurry. Although probe cells such as the oxidation reduction potential (ORP) device described by T. C. Burnett, Pulp and Paper Magazine of Canada, Vol, 71, No. 14, July 17, 1970, pg. 57–62 may be used to measure caustic residual within a limited concentration range, beyond this range the instrument reverses polarity and proceeds irradically. Usually, at less than 8 grams of residual caustic (as $Na_2O$) per 100 liters of solution (points) and less than 9.3 pH, conditions critical to a control range which spans from 100.00 points residual and 11.0 pH to 0.0 points residual and 7.0 pH, ORP cell signals become false and unreliable.

It is, therefore, an object of the present invention to teach a method and apparatus for reliably measuring the concentration of caustic residual in a pulp slurry flow stream.

A further object of the present invention is to teach a relatively simple caustic flow control system regulated by residual caustic concentration sensors.

BRIEF DESCRIPTION OF THE INVENTION

The present invention arises from the discovery that in a reactive system comprising a caustic solution, the concentration of residual or unreacted caustic may be objectively measured as a function of the voltage differential between respective poles of an electrolytic cell in which the caustic solution is the electrolyte and metallic walls of a container for said solution is one of the poles. The other pole of the cell is fabricated from a different metal appropriately removed from the container metal reference on the electromotive series scale.

As applied to the bleaching of paper pulp wherein the caustic compound is usually sodium hydroxide and the container wall material is a ferrous metal, it is convenient to utilize the container material as one pole with the other pole material selected from metals removed from iron on electromotive series.

In those locations in the causticized pulp flow stream where a high degree of reactivity is proceeding due to high temperature and caustic residual concentration, the container vessel walls will usually be fabricated from a stainless steel such as type 304. In this case, it is convenient to use a large mass, lead-tin alloy for the cell cathode.

In flow stream locations where the reactivity is more modest, such as at the end of the causticizing plant stream, a small mass of commercially pure platinum serves as a suitable anode. Being iron, the container wall serves as an infinite area cathode which never needs replacement or cleaning maintenance.

The electric potential difference between the respective cathodes and anodes is a function of the caustic residual of the solution. Consequently, a voltmeter may be calibrated directly in units of caustic residual concentration such as grams of $Na_2O$ per 100 liters of solution.

Additionally, the cell voltage may be used to regulate a caustic flow control system. In this embodiment of the invention, cell voltage signals are detected from sensors disposed approximately within 1 minute and 30 to 60 minutes, respectively, down stream of the caustic injection point. Consistent therewith, the late flow stream sensor signal is compared to a manual set-point reference signal to drive a first error signal which is cascaded against the early flow stream sensor to produce a second error signal. A motorized valve control over the flow of caustic to the pulp flow stream is regulated by the second error signal.

BRIEF DESCRIPTION OF THE DRAWING

Relative to the several figures of the drawing wherein like reference characters designate the same or similar element.

DESCRIPTION OF THE PREFERRED EMBODIMENT

Figure 1:
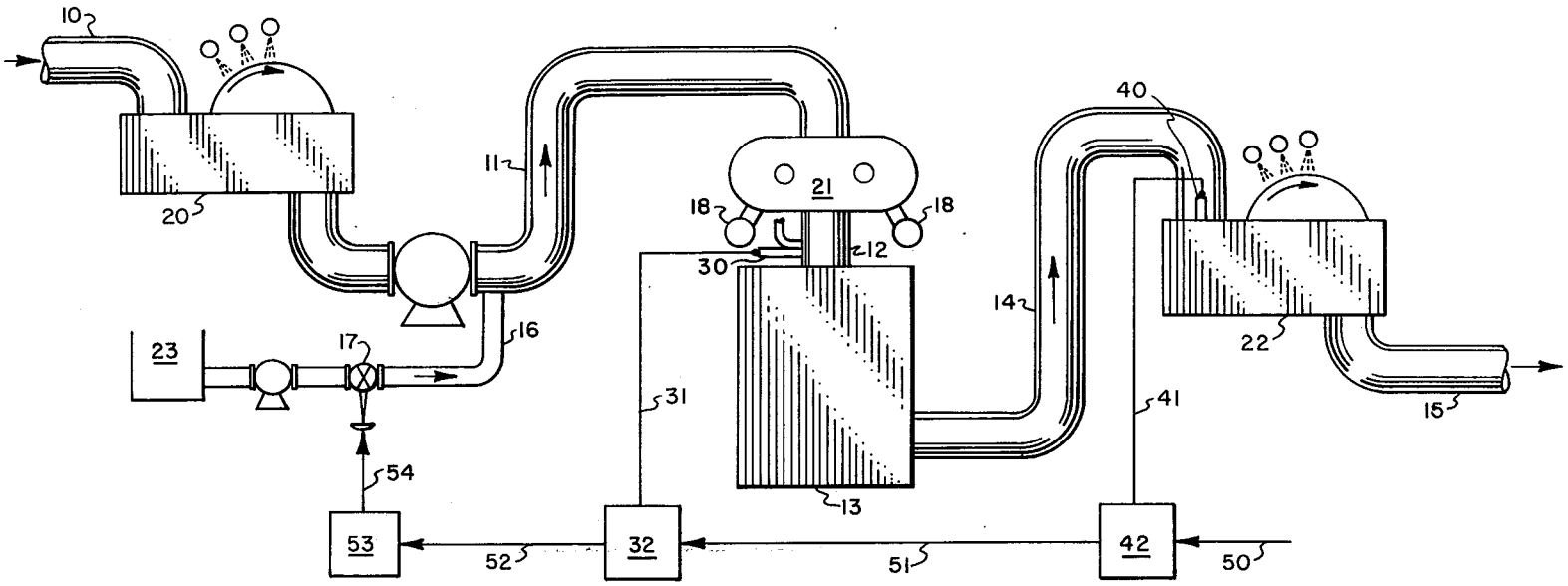
FIG. 1 is a flow schematic of a causticizing section in a paper pulp bleaching system.

The macro-flow scheme of the present invention is illustrated schematically by FIG. 1 wherein chlorinated pulp is delivered through conduit 10 to one or more chlorine washers 20 where the fibers are grossly separated from the chlorinated aqueous solution carrier and flushed with fresh water.

The washed and reslurried fibers are further pumped through conduit 11 to a steam mixing apparatus 21. In transit to the steam mixer 21, caustic, usually in the form of sodium hydroxide drawn from a storage vessel 23 through conduit 16 and flow controlled by a motor valve 17, is injected into the conduit stream 11.

Steam mixer 21 is a mechanical agitation device which tumbles and stirs the pulp and caustic into homogeneous mixture while steam from injectors 18 raise the temperature thereof to an effective reaction level, usually in excess of 170° F.

A short delivery conduit 12 connects the steam mixer 21 to a large, caustic retention vessel 13 which holds the caustic-pulp slurry in transit for a residence time of approximately 30 to 60 minutes.

From the caustic retention vessel 13, the slurry is pumped via conduit 14 to one or more caustic wash vessels 22 similar to the chlorine washers 20.

From the caustic washers 22, the reslurried pulp is delivered by conduit 15 to the next process step in the bleach system which may be a calcium hypochlorite or chlorine dioxide treatment.

Figure 2:
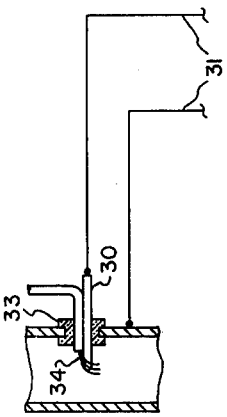
FIG. 2 is a detailed schematic of an embodiment of the present sensor invention suitable for application in a high temperature and caustic concentration environment wherein the vessel wall is fabricated from stainless steel.

Relative to the present invention, the electrochemical sensor 30 is a short residence time caustic residual monitor disposed in the connective conduit 12 between the steam mixer 21 and the caustic retention vessel 13 in the manner illustrated by FIG. 2. In this embodiment, a two pound electrochemical probe cathode 30 alloyed from substantially 50 percent tin and 50 percent lead was found to have a very satisfactory useful life of several months in the 180° f, 10.0 + pH environment of the hot, caustic slurry. This probe is positioned directly in the slurry flow stream through an aperture in the ferro-metallic wall of conduit 12. An electrically insulating grommet 33 seals the aperture around the probe 30 and electrically isolates it from the reference potential of the conduit wall.

A purge water flow of 10 to 20 gpm will improve the reliability and consistency of signal emissions from the probe 30 by continuously cleaning it of stock accumulations.

Under the electrolytic cell conditions described, an electromotive potential difference in the proximity of 300 millivolts may be detected between the probe 30 and the 304 type stainless steel walls of conduit 12. This potential difference will vary as a function of the unreacted, sodium hydroxide residual found in the aqueous solution slurry vehicle at this point in the flow stream. Consequently, this potential difference between probe 30 and the conduit 12 wall may be relied upon as an objective indication of caustic demand by the system. Moreover, due to the short, approximately one minute, available reaction time between the moment of caustic combination with the slurry to the moment of sensor 30 measurement, the voltage differential between the sensor cathode and conduit 12 wall may be used to control short duration, high amplitude disturbances in the caustic demand. Such flow control takes the form of signal 31 transmission of the sensor 30 potential difference measurement to a remote setpoint controller 32 which compares the signal 31 magnitude to a reference signal 51. The magnitude of difference between signals 31 and 51 represents a set-point difference which controller 32 uses to generate an error signal 52 which is transmitted to an electro-pneumatic converter 53 which appropriately corrects the setting of flow control valve 17.

Figure 3:
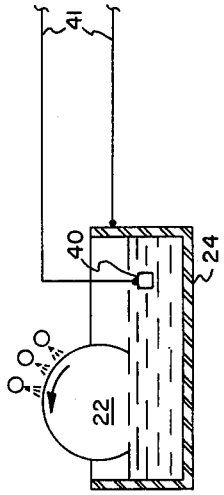
FIG. 3 is a detailed schematic of an embodiment of the present sensor invention suitable for application in a more moderate temperature and concentration environment wherein the vessel wall is fabricated from carbon steel.

Electrochemicl sensor 40 is a long residence time caustic residual monitor disposed about 30 to 60 minutes downstream of the caustic injection point in a conveniently remote location in the caustic flow stream which, as illustrated by FIG. 3 of the present embodiment, is in the supply bin of the caustic washer 22. At this point, the flow stream has cooled considerably and the predominance of originally available caustic has been reacted. Accordingly, the degree of solublized caustic residual is substantially reduced. Under these circumstances, the anode of sensor 40 comprises an approximately 1.5 square inch surface area sheet of commercially pure platinum. The 317 stainless steel ferrometallic wall of the washer 22 vessel represents a cathode of relatively infinite area. An approximately 300 millivolt potential difference may be expected across the plates of this electrolytic cell, also.

As in the case of sensor 30, the electromotive potential of sensor 40 is a function of the solublized caustic residual concentration. Accordingly as a signal 41, this potential may be directed to a controller 42 for comparison to a manually determined set point signal 50. The magnitude of difference between signals 41 and 50 is utilized by controller 42 to generate an error signal 51 which is used as a set-point or reference signal for the controller 32.

The aforedescribed sensor signal management will be recognized as a simple cascade control over the caustic flow valve 17 wherein the late stream sensor 40 detects long term, low amplitude departures of the caustic residual concentration from desired norms. When the controller modified error signal 51 resulting from the late stream sensor 40 is applied as a comparative setpoint for the signal 31 from early stream sensor 30, a stable but moderately shifting reference is provided for signal 31 comparison.

Figure 4:
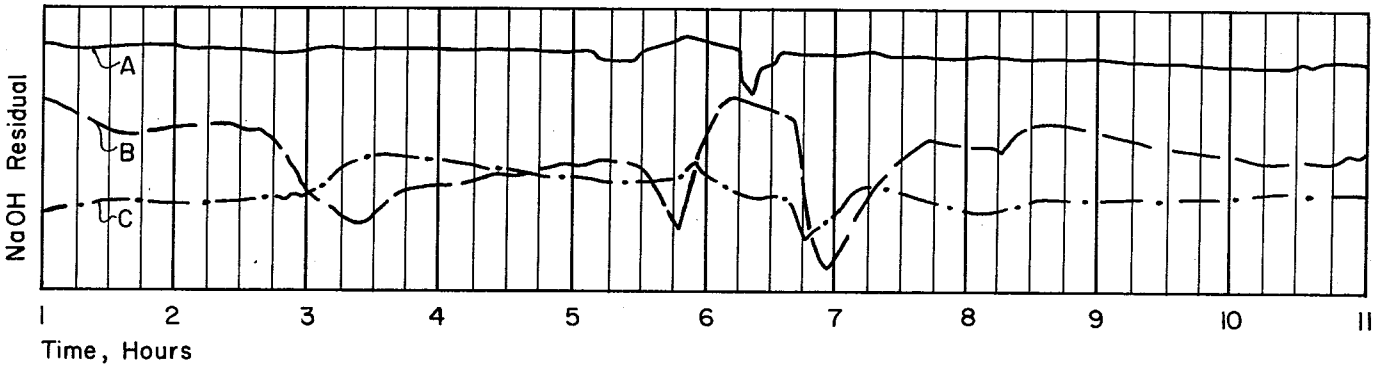
FIG. 4 is a graph of changes in caustic residual relative to time in a pulp bleach flow system as reported by sensors of the present invention and an ORP sensor for comparison.
Figure 5:
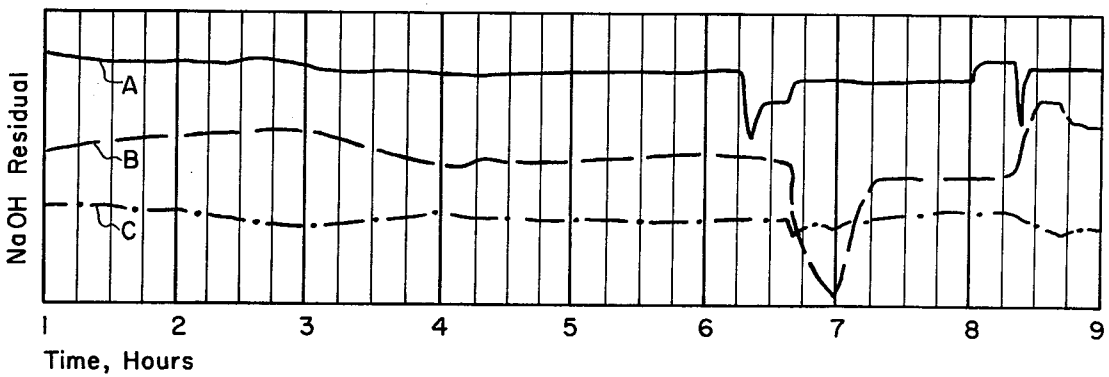
FIG. 5 is another graph of changes in caustic residual relative to a different time interim for the same pulp bleach system and sensors of FIG. 4.

To illustrate the sensory reliability of the present invention in comparison to caustic residual monitoring by a platinum/silver ORP sensor, such an ORP sensor was placed in operation alongside of the platinum sensor 40 of the present invention in the washer vat 2. The charts of FIGS. 4 and 5 represent the voltaic responses from the several sensors in the flow stream. Relative to both FIGS. 4 and 5, graph A records the response from sensor 30 located immediately downstream of the mixer 21. Graph B records the response from sensor 40 in the washer vat 22 and graph C records the ORP sensor response.

In flow stream transit time, curves B and C lag curve A by approximately 30 minutes so that an upset in the caustic residual detected by sensor 30 is not reported by sensor 40 or the ORP device until 30 minutes later.

No data could be taken from an ORP sensor at the mixer 21 since the reactive conditions at this point are so extreme, such a sensor is incapacitated immediately.

Relative to the events recorded by FIG. 4, at time 2 hours the solution residual at the washer 22 was 14.0 points (grams $Na_2O$ per 100 liters solution) and 9.6 pH. At time 2.7 hours, the caustic residual began to fall as represented by the sharp negative slope of curve B. Shortly thereafter, at about time 3.0 hours, the ORP sensor responded accordingly as represented by the accelerating positive slope of curve C. The fact that the charted responses of sensor 40 and the ORP device are opposite is irrelevant since the ORP signal could have been inverted to ± similar to that of the invention.

The important point to be observed from the charted responses of curves B and C over this time interim is that they correspond with a generally inverse proportionality.

By time 5.0 hours, the caustic residual of the pulp solution at the washer vat has risen back to 10.0 points and the pH was 9.4.

At time 5.15 hours sudden dimunition in caustic residual occurred in the system at sensor 30 as indicated in curve A. Thirty minutes later, at time 5.65 hours, such dimunition is detected by the sensor 40 as indicated by the sharp downturn of curve B. Residual diminishment at sensor 40 continues until time 5.8 hours when the curve B peaks and starts back up. Caustic residual in the washer 22 solution at time 5.8 hours was measured as 2.0 points and 8.8 pH.

Throughout the period of washer residual diminishment from time 5.65 to 5.8 hours, the ORP sensor has remained stable and non-responsive. At time 5.8 l hours however, curve C starts a strong positive slope. At the same moment (time 5.8 hours) that the sensor 40 indicates the start of an increasing residual concentration, the ORP sensor indicates a decreasing concentration. Such reverse behavior of the ORP sensor continues until time 5.9 hours when the positive slope of curve C peaks and starts down as curve B continues to rise.

At time 6.2 hours of FIG. 4, the washer solution was measured to have a 22 point residual and 10.1 pH.

At time 6.25 hours, the system was deliberately upset by a complete interruption of caustic supply from the conduit 16. This event is recorded by the sharp negative slope of curve A beginning at that time and continuing until time 6.33 whereupon the caustic flow is resumed and the residual at the mixer 21 begins to rise. Response from the present invention sensor 40 continues to follow the upset event with a generally direct, but amplified, proportionality and at time 6.7 hours begins to fall rapidly until a low point is reached at time 6.9 hours. The washer 22 solution residual at time 6.9 hours was measured as 0.0 points and the pH as 7.6.

Correspondingly, curve C begins a sharp negative slope at time 6.6 hours which continues until time 6.75 hours whereupon it reverses and starts to rise until time 7.25 hours. At time 7.3 hours, curve C crosses the locus of curve B and begins another negative slope increment.

From the foregoing description of FIG. 4 it will be seen that the ORP sensor response to caustic residual changes is inconsistent. At times the response follows an inversely proportional correlation. At other times the correlation is directly proportional. Such erratic behavior and response reversal is intolerable for continuous process control. Manifestly, therefore, the ORP sensor is unsuitable for continuous bleach system control.

FIG. 5 illustrates a second occasion of response reversals of an ORP sensor under circumstances similar to those described above. From time 1.0 to time 6.6 hours, curve B and C follow a general inverse proportionality. At time 6.25 hours, the caustic supply to the flow stream was terminated as shown by the abrupt decline in residual concentration recorded by curve A.

When the caustic supply was terminated, solution at the washer 22 carried a 10.0 point residual and 9.8 pH.

Nearly 30 minutes later, the cessation of caustic supply is detected by the sensor 40 as reflected by the sharp, negative slope of curve B starting at time 6.7. Simultaneously, the ORP curve C responds but with a negative slope of short deviation having a direct proportionality relation to the B curve response.

Had the response pattern of curve C established up to time 6.7 hours been followed, a sustained, sharply positive slope locus should have occurred.

At time 7.0 hours, the washer solution residual was measured at 0.0 points and 7.2 pH. Such is indicated by the inverse peak of curve B at that time.

In the meantime, curve C provides very little response of any kind. Such apparent incapacitation seems to continue until time 8.3 hours when the curve responded with an inverse proportionality to an increase in caustic supply which originally entered the flow stream at time 8.0 hours.

At time 8.2 hours the washer 22 solution was measured to have 2.0 points residual and 9.2 pH. Another measurement at time 8.6 hours showed a residual of 30.0 points and 10.5 pH. At time 8.9 hours, the washer solution carried 22.0 points residual and 10.2 pH.

To be of any value and utility in controlling the causticizing segment of the pulp bleaching process, a sensor must respond with consistent proportionality, either direct or inverse, over a solution condition range that spans from 11 pH and 100 grams $Na_2O$ per 100 liters (points) to 7 pH and 0 points residual.

Consequently, as exemplified by the FIGS. 4 and 5 data, an ORP sensor is unacceptable for such service.

General experience indicates that an ORP sensor goes erratic at solution conditions of less than 9.3 pH and less than 8 points residual. However, such specifications are not to be taken as operational limits but represent the estimated average of field experience. Moreover, no attempt has been undertaken to analyze the cause and effect of ORP sensor reversals or incapacitation since it is sufficient for the present objective of caustic control to a paper pulp bleach system to know that the device is unreliable for the purpose intended under normal industrial conditions of operation.

While specific metals and alloys have been described as poles for the caustic residual sensors described herein, it should be understood that numerous other combinations of metals may be effectively used. Relative to the electromotive series which comprises a listing of metals arranged in decreasing order of tendency to pass into ionic form by yielding electrons, any two metals having adequate electromotive differential in the caustic electrolyte for detection may be used for detection. Preferably, however, the vessel will be used as an infinite area anode or cathode. Since such vessels are normally fabricated of ferrous metals, the opposite pole may be selected from those metals further removed on the electromotive series relative to iron. Suitable examples may include zinc, nickel, tin, lead, copper, platinum, silver and gold. This listing, however, is not exhaustive when it is appreciated, as represented by the early flow stream sensor cathode, that suitable alloys comprising additional metals may be compounded for the objective purpose.

Having fully described my invention, I claim:

1. A method of detecting the concentration of residual caustic in solution with an aqueous slurry of paper pulp, said method comprising the steps of:

A. Providing a slurry of wood fiber in an aqueous solution comprising chlorine and caustic within a ferrometallic container for said slurry;

B. Immersing a metallic material probe within said slurry as one pole of an electrolytic cell, said metallic material having a different tendency to ionize in said solution that iron and a consistent voltaic response to caustic concentration in said solution over a caustic residual concentration range of substantially 0.0 to 100.0 grams of caustic measured as sodium oxide per 100 liters of solution and an alkalinity range of substantially 7.0 to 11.0 pH;

C. Measuring between said probe and said container the electromotive force generated by the combination of said probe, said container and said slurry;

D. Correlating said electromotive force measurement to the concentration of residual, unreacted caustic in said solution as a function thereof.

2. A method as described by claim 1 wherein said ferrometallic container comprises a stainless steel flow conduit carrying said slurry at a temperature in excess of 170° F from a mixing apparatus to a retention vessel, said probe comprising an alloy of substantially equal portions of lead and tin.

3. A method as described by claim 2 wherein said probe is contstantly flushed with a 10 to 20 gallons per hour water flow.

4. A method as described by claim 1 wherein said ferrometallic container comprises a stainless steel reservoir positioned at least 30 minutes of slurry flow transit time downstream of a caustic compound injection point into said solution, said probe comprising a plate of substantially pure platinum.

5. A method of regulating the flow of a caustic compound into a chlorinated aqueous slurry of paper pulp comprising the steps of:

A. Injecting a substantially continuous flow stream of caustic into a flowing slurry of fibrous cellulose and lignin suspended in a chlorinated aqueous solution to combine with chlorinated lignin compounds therein, said caustic being injected at a rate sufficient to maintain a caustic residual concentration range of substantially 0 to 100 grams of caustic measured as sodium oxide per 100 liters of solution and an alkalinity range of 7 to 11 pH;

B. Mixing said slurry to homogenously distribute said caustic within said slurry;

C. Heating the causticized slurry to accelerate the combination rate of said caustic with said chlorinated lignin compounds;

D. Measuring the voltaic response of a first electrolytic cell which comprises the heated, causticized slurry as an electrolyte and a ferro-metallic wall of a vessel confining said slurry as one of at least two cell poles, the other cell pole being of a metallic material having a different tendency to ionize in said causticized slurry than iron and also a consistent voltaic response in said causticized slurry over said entire residual concentration and alkalinity range;

E. Generating a first signal proportional to voltaic response measurements of said first cell;

F. Retaining said causticized slurry as a reactive system for at least thirty minutes of flow transit time following said caustic injecting;

G. Measuring the voltaic response of a second electrolytic cell comprising said causticized slurry after said retaining time as an electrolyte, a ferro-metallic wall of a vessel confining said causticized slurry as one cell pole and a metallic material having a different tendency to ionize in said causticized slurry than iron and also a consistent voltaic response in said causticized slurry over said entire residual concentration and alkalinity range as another cell pole;

H. Generating a second signal proportional to voltaic response measurements of said second cell;

I. Comparing said second signal to a set-point reference signal to derive a first error signal;

J. Comparing said first signal to said first error signal to derive a second error signal; and, K. Controlling the flow rate of caustic into said flowing slurry as a function of said second error signal.

6. A method as described by claim 5 wherein said causticized slurry is carried by a stainless steel container from said mixing step, said first cell other pole comprising substantially equal portions of lead and tin.

7. A method as described by claim 5 wherein said causticized slurry is carried by a stainless steel container at the end of said retaining time, said second cell other pole comprising substantially pure platinum.

8. Apparatus for detecting the concentration of residual caustic in solution with a chlorinated aqueous slurry of paper pulp wherein said solution is an electrolytic cell electrolyte having a caustic residual concentration within the range of 0 to 100 grams caustic measured as sodium oxide per 100 liters of solution and an alkalinity within the range of 7 to 11 pH, said apparatus comprising:

A. A vessel having ferro-metallic containment walls contacting said causticized slurry electrolyte;

B. Cathode means comprising an alloy of substantially equal proportions of lead and tin in contact with said electrolyte; and C. Means to measure between said ferro-metallic walls and said cathode means the voltaic response thereof to changes in the concentration of residual caustic within said solution.

9. An apparatus for regulating the flow of caustic compound into solution with a chlorinated aqueous slurry of paper pulp comprising:

A. A ferro-metallic conduit for a flow stream of said slurry;

B. A conduit for delivering a caustic compound into solution with said slurry flow stream at an injection point and at a rate sufficient to maintain within said solution a caustic residual concentration within the range of 0 to 100 grams of caustic measured as sodium oxide per 100 liters of solution and an alkalinity range of 7 to 11 pH.

C. Means for heating the causticized slurry above 170° F;

D. A first electrolytic cell means comprising said heated, causticized slurry as an electrolyte, said ferro-metallic conduit as a first cell pole and a second cell pole of metallic material having a different tendency to ionize in said causticized slurry than iron and also a consistent voltaic response in said heated, causticized slurry over said entire residual concentration and alkalinity range;

E. Means for measuring the voltaic response of said first cell to changes in caustic residual concentration within said heated, causticized slurry;

F. First signal means for generating a first signal porportional to said voltaic response of said first cell;

G. Flow stream retention means for retaining said causticized slurry as a reactive system for at least 30 minutes following said caustic injection;

H. A second electrolytic cell means comprising said causticized slurry at a flow point subsequent to said retention means as an electrolyte, said ferro-metallic conduit as a first cell pole and a second cell pole of metallic material having a different tendency to ionize in said causticized slurry than iron and also a consistent voltaic response to said causticized slurry over said entire residual concentration and alkalinity range;

I. Means for measuring the voltaic response of said second cell to changes in caustic residual concentration within said causticized slurry;

J. Second signal means for generating a second signal proportional to said voltaic response of said second cell;

K. Means to compare said second signal to a setpoint reference signal to derive a first error signal;

L. Means to compare said first signal to said first error signal to derive a second error signal; and, M. Means to control the flow rate of caustic into said flowing slurry as a function of said second error signal.

10. An apparatus as described by claim 9 wherein the second pole of said first cell comprises an alloy of lead and tin.

11. An apparatus as described by claim 9 wherein the second pole of said second cell comprises platinum.

12. An apparatus as described by claim 11 wherein the first pole of said second cell comprises stainless steel.

* * * * *

UNITED STATES PATENT OFFICE
CERTIFICATE OF CORRECTION

PATENT NO. : 4,065,348

DATED : December 27, 1977

INVENTOR(S) : William E. Zimmerman

It is certified that error appears in the above-identified patent and that said Letters Patent are hereby corrected as shown below:

Column 1, line 25, delete "pump" and insert therefor --pulp--. Column 4, line 26, correct the spelling of "Electrochemical"; line 66, "2" should be --22--. Column 5, line 29, following "vat" the verb "has" should be --had--; line 42, delete "1". Column 7, line 22 (Claim 1, line 10), "that" should be --than--. Column 9, line 15 (Claim 9, line 27), correct the spelling of "proportional". Column 10, line 1 (Claim 9, line 38), delete "to" and insert therefor --in--.

Signed and Sealed this

***Eleventh* Day of *April 1978***

[SEAL]

*Attest:*

RUTH C. MASON
*Attesting Officer*

LUTRELLE F. PARKER
*Acting Commissioner of Patents and Trademarks*